US007228912B2

(12) United States Patent
Patel et al.

(10) Patent No.: US 7,228,912 B2
(45) Date of Patent: Jun. 12, 2007

(54) METHOD AND SYSTEM TO DEPLOY CONTROL LINES

(75) Inventors: Dinesh R. Patel, Sugar Land, TX (US); Gilles H. Dessoulavy, Houston, TX (US); Matthew R. Hackworth, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 246 days.

(21) Appl. No.: 10/711,522

(22) Filed: Sep. 23, 2004

(65) Prior Publication Data

US 2005/0279510 A1 Dec. 22, 2005

Related U.S. Application Data

(60) Provisional application No. 60/521,692, filed on Jun. 18, 2004.

(51) Int. Cl.
*E21B 29/00* (2006.01)

(52) U.S. Cl. ..... 166/380; 166/65.1

(58) Field of Classification Search ..... 166/380, 166/65.1, 66
See application file for complete search history.

(56) References Cited

U.S. PATENT DOCUMENTS

| | | | | |
|---|---|---|---|---|
| 6,505,682 | B2 | 1/2003 | Brockman | |
| 2003/0192708 | A1* | 10/2003 | Koehler et al. | 166/385 |
| 2003/0221829 | A1* | 12/2003 | Patel et al. | 166/278 |
| 2004/0040707 | A1 | 3/2004 | Dusterhoft et al. | |
| 2005/0211441 | A1* | 9/2005 | Vold et al. | 166/378 |

FOREIGN PATENT DOCUMENTS

| | | | |
|---|---|---|---|
| GB | 2382831 | A | 11/2003 |
| GB | 2392461 | A | 3/2004 |
| GB | 2398806 | A1 | 6/2006 |
| WO | 2004/007910 | A1 | 1/2004 |

* cited by examiner

*Primary Examiner*—William Neuder
(74) *Attorney, Agent, or Firm*—Robert A. Van Someren; Bryan P. Galloway; Tim Curington

(57) ABSTRACT

A control line can be positioned in a downhole completion. For example, the control line can be deployed in a protected position along a stinger to reduce the potential for damaging the control line during installation, removal or operation.

32 Claims, 5 Drawing Sheets

METHOD AND SYSTEM TO DEPLOY CONTROL LINES

CONTINUITY INFORMATION

The following is also based upon and claims priority to U.S. Provisional Application Ser. No. 60/521,692, filed Jun. 18, 2004.

BACKGROUND

Control lines, such as individual or combined hydraulic, electric, or fiber control lines, are used in oil and gas wellbores to control downhole tools or to carry data related to measuring wellbore or environmental parameters. However, many obstacles to the deployment of a control line along the length of the wellbore exist. For example, packers are commonly deployed in wellbores and block the path down a wellbore. Moreover, if the control line is exposed on its exterior, the control line can be damaged as it is inserted and removed from the wellbore.

Thus, there is a continuing need to address one or more of the problems stated above.

SUMMARY

The present invention relates to a system and method to deploy control lines in wellbores. The control lines are deployed in a protected manner and, in some embodiments, serve to provide control line functionality through packers or other components.

Advantages and other features of the invention will become apparent from the following drawing, description and claims.

DETAILED DESCRIPTION

The present invention generally relates to completions utilized in a well environment. The completions comprise one or more control lines.

As used herein and unless otherwise noted, the term "control line" shall include all types of control lines, including hydraulic control lines, electric lines, wirelines, slicklines, optical fibers, and any cables that house or bundle such lines or fibers. Control lines may be used to control downhole device (such as any downhole tool—packers, flow control valves, etc), transmit information, or measure parameters.

Figure 1:
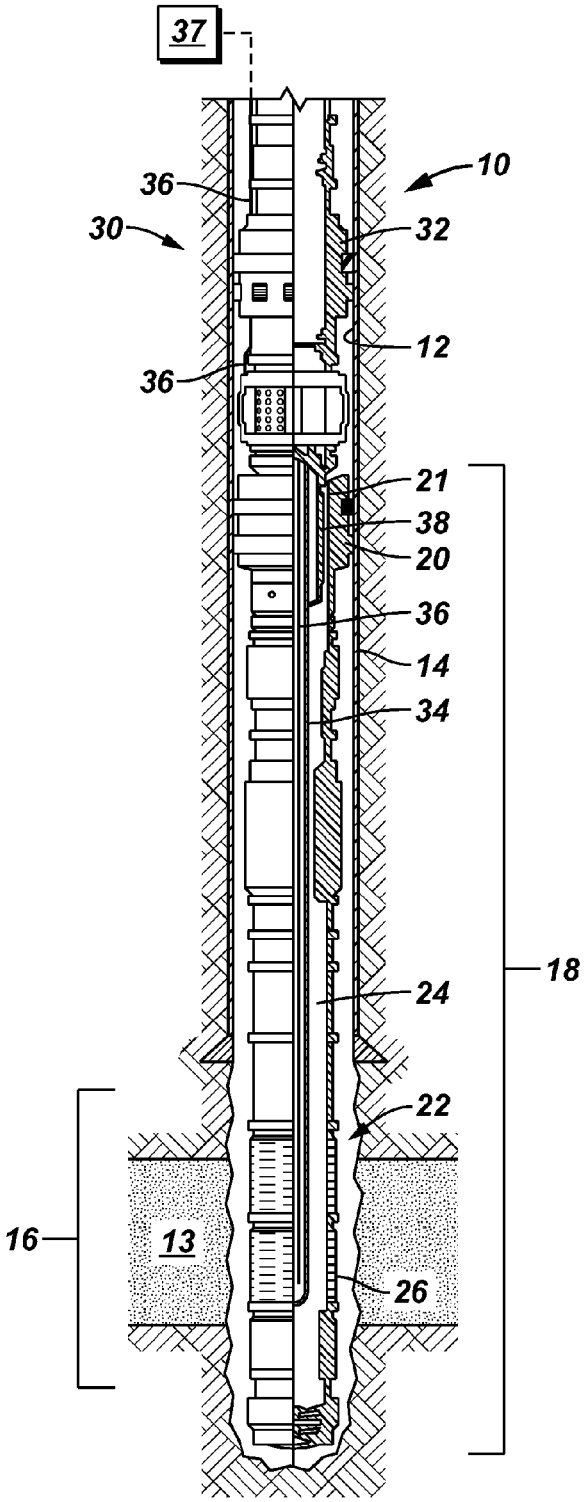
FIG. 1 is a front elevation view taken in partial cross-section of a system according to one embodiment of the present invention.

FIG. 1 illustrates a first embodiment of the present invention. A completion 10 is deployed in a wellbore 12. The wellbore 12 may include casing 14 along a portion of its length, with the bottommost section 16 not cased. In alternative embodiments, the entire wellbore 12 is cased, or the entire wellbore 12 is not cased. The wellbore 12 extends from a subterranean location to a surface location, such as the surface of the earth (not shown). The wellbore 12 may be a land well or an offshore well. The wellbore 12 intersects at least one formation 13 from which fluids (such as hydrocarbons) are produced to the surface or into which fluids (such as water or treating fluids) are injected.

A lower completion 18 is deployed in the wellbore 12. The lower completion 18 includes a packer 20, which seals and anchors the lower completion 18 to a surrounding wall, such as casing 14 (or wellbore wall if the wellbore is not cased). The surrounding wall/casing 14 also can comprise other components, such as an expandable tubing or sand screen. The lower completion 18 also includes a fluid communication component 22 providing fluid communication between the exterior of the lower completion 18 and the interior bore 24 of the lower completion 18. In the embodiment illustrated in FIG. 1, fluid communication component 22 comprises a sand screen 26. In other embodiments, fluid communication component 22 comprises an expandable sand screen, a flow control valve (such as a sleeve valve), at least one port, or other components.

Figure 2:
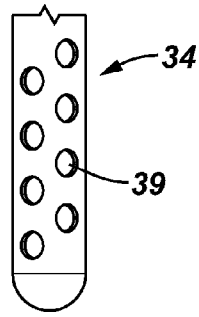
FIG. 2 illustrates a portion of one embodiment of the stinger illustrated in FIG. 1.

An upper completion 30 is deployed into the wellbore 12 and is inserted into the lower completion 18. The upper completion 30 comprises a packer 32, a stinger 34, a control line 36, and at least one flow port 39. After the upper completion 30 is run into the well, the packer 32 is set against the casing 14 (or the wellbore wall if no casing 14 is present). The packer 32 seals and anchors the upper completion 30 to the casing 14. An engagement section 38 is inserted into the bore 21 of the lower completion packer 20. The stinger 34 extends into the lower completion bore 24 and may extend across the fluid communication component 22. As shown in FIG. 2, the stinger 34 includes at least one flow port 39 that provides fluid communication between the exterior and interior of the stinger 34. The at least one flow port 39 can be located in the side or a bottom of the stinger. The part of the stinger 34 including the at least one flow port 39 may comprise perforated or slotted pipe. In an alternative embodiment, the stinger 34 is deployed subsequent to the packer 32 and engagement section 38.

The control line 36 extends along at least part of the length of the stinger 34. In one embodiment, the control line 36 extends along the length of the stinger 34 and across the fluid communication component 22. The control line 36 typically extends upwards along the upper completion 30 and to the surface and is functionally connected to an acquisition unit 37.

In one embodiment as shown in FIG. 1, the control line 36 is deployed in the interior of the stinger 34. The control line 36 crosses to the exterior of the upper completion 30 above the lower completion packer 20 and is fed through a by-pass port of the upper completion packer 32. In other applications, control line 36 can extend toward or to the surface in the interior of the stinger.

Figure 3:
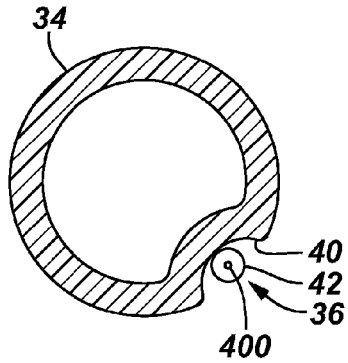
FIG. 3 illustrates an alternate embodiment of the stinger illustrated in FIG. 1.

In another embodiment as shown in FIG. 3, the control line 36 extends along a recess 40 located in a wall of the stinger 34 and is directly fed through the by-pass port of the upper completion packer 32. In the example illustrated, recess 40 is located on an exterior of stinger 34, although it can be located within an interior. In one embodiment, the recess 40 extends substantially longitudinally along the stinger 34. In another embodiment (not shown), the recess 40 extends helically up the stinger 34. The recess 40 serves as a protection mechanism and protects the control line 36 when the upper completion 30 is run into or out of the wellbore 12 and lower completion 18.

Figure 4:
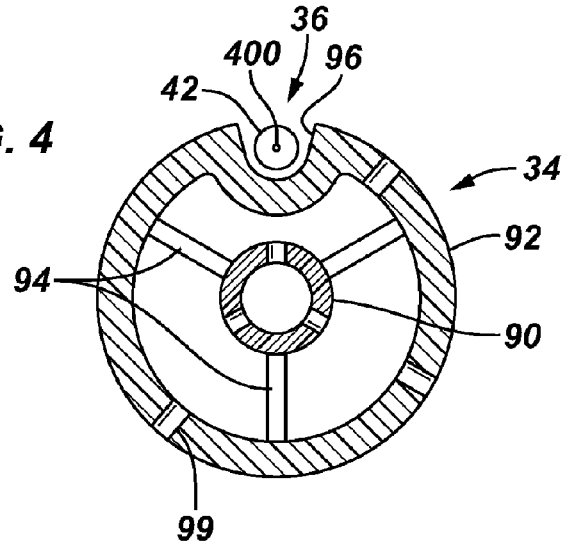
FIGS. 4-6 illustrate additional alternative embodiments of the stinger illustrated in FIG. 1.

In another embodiment illustrated in FIG. 4, stinger 34 comprises a perforated base pipe 90 and an outer shroud 92. Base pipe 90 includes at least one opening 98 therethrough and is connected to the shroud 92 by way of attachments 94. Shroud 92 also has at least one opening 99 therethrough and includes a recess 96 as previously described in relation to FIG. 3. The control line 36 extends along the recess 96.

Figure 5:
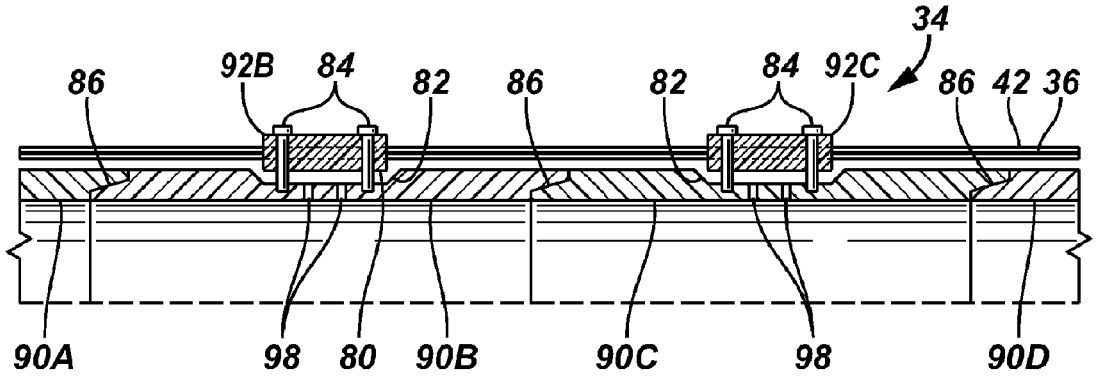

In another embodiment as shown in FIG. 5, stinger 34 comprises perforated base pipe sections 90 (such as 90A-D) and outer shroud sections 92 (such as 92B and C). Each base pipe section 90 has a corresponding outer shroud section 92, and each base pipe section 90 includes at least one opening 98 therethrough. Each shroud section 92 is rotationally engaged to its corresponding base pipe section 90 such as by having mating profiles 80, 82 that prevent axial movement therebetween. When the shroud section 92 and the base pipe section 90 are in correct rotational alignment, screws 84 are inserted through the shroud section 92 and are set against the base pipe section 90, thereby locking the shroud section 92 to the base pipe section 90. Each shroud section 92 includes a recess (such as the recess shown in FIG. 3) to accommodate and protect the control line 36.

The embodiment of FIG. 5 is particularly beneficial in manufacturing and assembling the stinger 34. Each base pipe section 90 arrives with its corresponding shroud section 92 rotationally connected thereto. The stinger 34 is then assembled by threading the base pipe sections 90 together, such as at threads 86. Next, the control line 36 is disposed within the recesses of adjoining shroud sections 92. The shroud sections 92 can be rotationally shifted to enable such alignment. When the recesses of adjoining shroud sections 92 are aligned, each of the two shroud sections 92 is locked to its base pipe section 90 by the use of screws 84 as previously disclosed. The process is continued until the entire stinger 34 is assembled. This technique enables the use of regular threads 86 on base pipe sections 90, as opposed to more costly premium threads.

Figure 6:
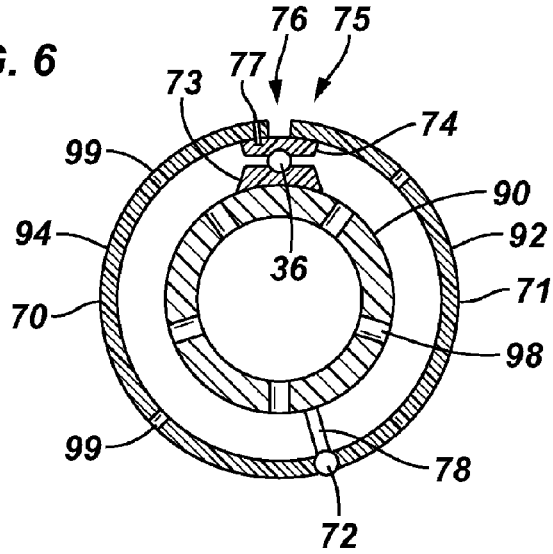

In another embodiment as shown in FIG. 6, stinger 34 comprises a perforated base pipe 90 and a split outer shroud 92. Base pipe 90 includes at least one opening 98 therethrough. Shroud 92 also has at least one opening 99 therethrough. In this embodiment, shroud 92 is constructed of two sections 70, 71 that, combined, encircle the base pipe 90. The shroud sections 70, 71 are pivotally joined at a pivot point 72 so the shroud 92 can be assembled onto the base pipe 90. Base pipe 90 and shroud section 92 also contain halves 73, 74, respectively, of a clamp 75 so that when shroud section 92 encircles base pipe 90, the control line 36 is retained in the clamp 75. A locking mechanism 76, such as a set screw 77, locks the shroud section 92 on the base pipe section 90. A spacer or spacers 78 may be inserted to provide adequate centralization between the shroud section 92 and the base pipe section 90.

In one embodiment in which the control line 36 includes an optical fiber, the optical fiber 36 and acquisition unit 37 comprise a distributed temperature sensor system, such as the Sensa DTS systems sold by Sensor Highway Limited, Southampton, UK. Generally, pulses of light at a fixed wavelength are transmitted from the acquisition unit 37 through the fiber optic line 36. At every measurement point in the line 36, light is back-scattered and returns to the acquisition unit 37. Knowing the speed of light and the moment of arrival of the return signal enables its point of origin along the optical fiber 36 to be determined. Temperature stimulates the energy levels of the silica molecules in the fiber line 36. The back-scattered light contains upshifted and downshifted wavebands (such as the Stokes Raman and Anti-Stokes Raman portions of the back-scattered spectrum) which can be analyzed to determine the temperature at origin. In this way the temperature of each of the responding measurement points in the fiber line 36 can be calculated by the unit 37, providing a complete temperature profile along the length of the fiber line 36. This general fiber optic distributed temperature system and technique is known in the prior art.

In another embodiment, control line 36 is connected to a sensor (not shown), which transmits its measurements to the acquisition unit 37 via the control line 36. The sensor can be a hydraulic, mechanical, chemical, electrical, or optical sensor and can measure any downhole characteristic, including physical and chemical parameters of the well fluid and environment. For instance, the sensor can comprise a temperature sensor, a pressure sensor, a strain sensor, a flow sensor, or phase sensor. In another embodiment, fiber optic line 36 may be used to take a distributed strain measurement along the length of the fiber optic line(s) 36.

In one embodiment in which an optical fiber is included, the control line 36 comprises a conduit 42 and an optical fiber 39. Instead of deploying the optical fiber 39 by itself or bundled in a cable and attaching it to the upper completion 30, the optical fiber 39 can be deployed within a conduit 42 (see FIG. 3). The conduit 42 may be located in the interior of stinger 34 and then crossed over to the exterior of stinger 34, as shown in relation to the optical fiber 39 in FIG. 1. Or, the conduit 42 may be deployed within the recess 40 on, for example, the exterior of stinger 34 as shown and described in relation to FIG. 3.

In one embodiment, conduit 42 is deployed with fiber optic line 39 already disposed therein. However, in another embodiment, conduit 42 is first deployed with the upper completion 30, and fiber optic line 39 is thereafter installed in the conduit 42. In this technique, fiber optic line 39 is pumped down conduit 42. Essentially, the fiber optic line 39 is dragged along the conduit 42 by the injection of a fluid at the surface, such as injection of fluid (gas or liquid) by a pump. The fluid and induced injection pressure work to drag the fiber optic line 39 along the conduit 42. This installation technique can be specially useful when a fiber optic line 39 requires replacement during an operation.

The control line 36 may have a "J-shape", wherein the control line 36 returns from the bottom of its extension along the stinger 34 and extends back at least partially to the surface, or a "U-shape", wherein the control line 36 returns from the bottom of its extension along the stinger 34 and extends back completely to the surface. Either of these shapes is beneficial when the control line 36 includes an optical fiber 39 and the optical fiber 39 is used as part of a distributed temperature sensor system. Additionally, although one control line 36 is shown as being used in relation to the embodiment of FIGS. 1-3, it is understood that more than one control line 36 may be deployed with embodiments described herein.

In operation, the lower completion 18 is deployed in the wellbore 12 and the packer 20 is set sealingly anchoring the lower completion 18 to the wellbore 12. The upper completion 30 is then deployed and the packer 32 is set once the upper completion 30 is in the appropriate position (in an alternative embodiment, the stinger 34 is deployed subsequent to the packer 20 and engagement section 38). If the wellbore 12 is a producing wellbore, fluid flows from the formation 13, into the wellbore 12, through the fluid communication component 22, into the lower completion interior bore 24, through the at least one flow port 39, and through the upper completion 30 to the surface. If the wellbore is an injection wellbore, fluid flows in the opposite direction from the surface and into the formation 13. If the control line 36 and unit 37 comprise a distributed temperature sensor system, distributed temperature traces are taken along the length of the control line to provide the required information for the operator. If the control line 36 is used to control downhole devices, an operator may then activate such control. If the control line 36 transmits information to the surface, such information may then be transmitted.

Figure 7:
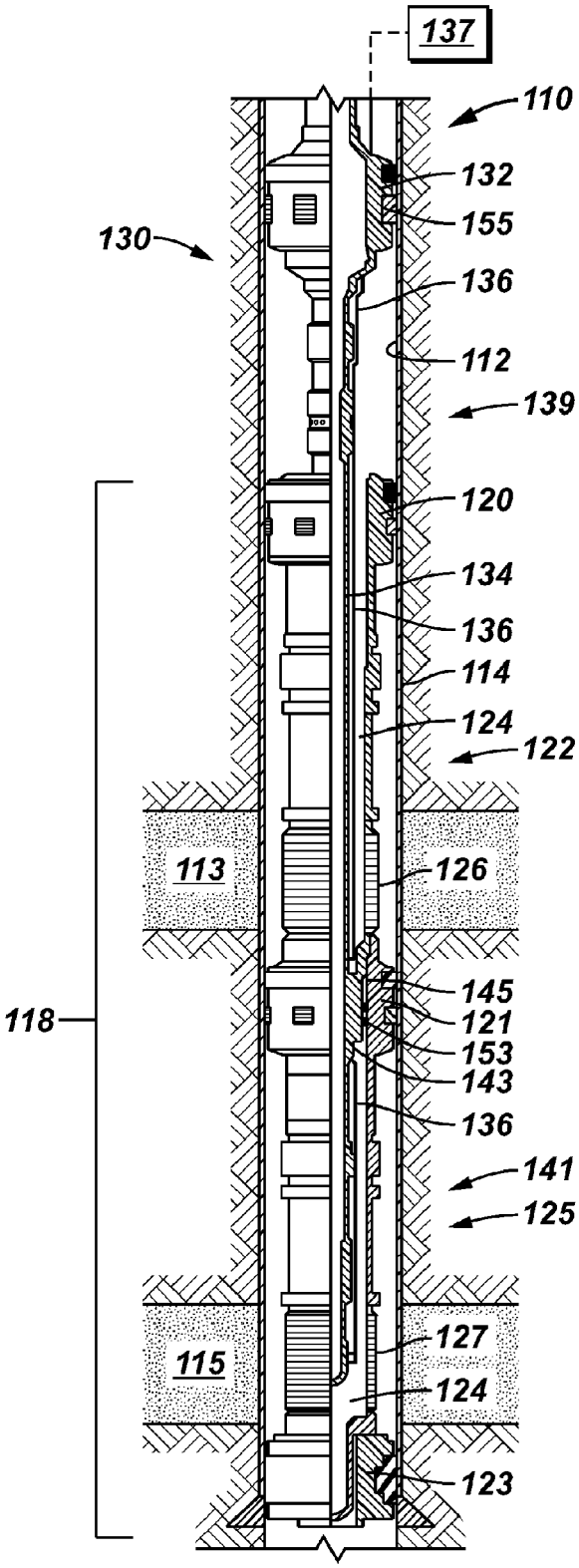
FIG. 7 is a front elevation view of an alternate embodiment of the system illustrated in FIG. 1.

FIG. 7 illustrates another embodiment of the present invention. A completion 110 is deployed in a wellbore 112. The wellbore 112 may or may not include casing 114. The wellbore 112 extends from a subterranean location to, for example, the surface of the earth (not shown). The wellbore 112 may be a land well or an offshore well. The wellbore 112 intersects at least two formations 113, 115 from which fluids (such as hydrocarbons) are produced to the surface or into which fluids (such as water or treating fluids) are injected from the surface.

A lower completion 118 is deployed in the wellbore 112. The lower completion 118 includes at least two packers 120, 121. Packer 120 seals and anchors the lower completion 118 to the casing 114 (or wellbore wall if the wellbore is not cased) above the upper formation 113, and packer 121 seals and anchors the lower completion 118 to the casing 114 (or wellbore wall if the wellbore is not cased) between the upper formation 113 and the lower formation 115. A third and bottommost packer 123 may also be used to seal and anchor the lower completion 118 below the lower formation 115. Proximate each of the packers 120, 121, the lower completion 118 also includes a fluid communication component 122, 125 providing fluid communication between the exterior of the lower completion 118 and the interior bore 124 of the lower completion 118. In the embodiment illustrated in FIG. 7, fluid communication components 122, 125 comprise sand screens 126, 127. In other embodiments, fluid communication components 122, 125 can comprise components, such as expandable sand screens, flow control valves (e.g., sleeve valves), at least one port, or combinations thereof.

An upper completion 130 is deployed into the wellbore 112 and is inserted into the lower completion 118. The upper completion 130 comprises a packer 132, a stinger 134, a control line 136, two flow control components 139, 141, and a sealing sleeve 143. After the upper completion 130 is run into the well, the packer 132 is set against the casing 114 (or the wellbore wall if no casing 114 is present). The packer 132 seals and anchors the upper completion 130 to the casing 114. The sealing sleeve 143 of the stinger 134 is inserted into the bore 145 of the lower completion packer 121 and provides a seal between the upper completion 130 and the lower completion 118. The stinger 134 extends into the lower completion bore 124 and across upper fluid communication component 122 and may extend across the bottom fluid communication component 125.

The control line 136 extends along at least part of the length of the stinger 134. In one embodiment, the control line 136 extends along the length of the stinger 134 and across the fluid communication components 122, 125 and flow control components 139, 141. The control line 136 typically extends upwards along the upper completion 130 and to the surface and is functionally connected to an acquisition unit 137.

Figure 8:
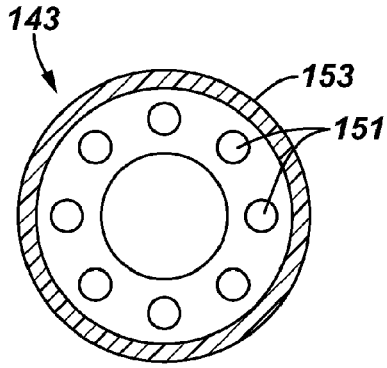
FIG. 8 is an illustration of one embodiment of the sealing sleeve illustrated in FIG. 7.

In this embodiment, the control line 136 extends along the exterior of the stinger 134. The sealing sleeve 143, which is shown in cross-section in FIG. 8, includes at least one by-pass port 151 longitudinally therethrough as well as seals 153 on its exterior. Seals 153 sealingly engage the lower completion packer bore 145. The control line 136 is sealingly fed through the at least one sealing sleeve by-pass port 151 with the remainder of the unused by-pass ports 151 being sealed (unless otherwise used by other control lines). Above the sealing sleeve 145, the control line 136 is directly sealingly fed through the by-pass port 155 of the upper completion packer 132. In one embodiment, the stinger 134 includes a recess (such as the recess 40 of the embodiment described in relation to FIGS. 1-3) used to protect the control line 136. In another embodiment, the control line 136 (if it includes an optical fiber) and acquisition unit 137 comprises a distributed temperature sensor system as previously described in relation to the embodiment of FIGS. 1-3. In yet another embodiment, control line 136 is connected to a sensor (not shown) which transmits its measurements to the acquisition unit 137 via the control line 136. The sensor can measure any downhole characteristic, including physical and chemical parameters of the well fluid and environment. For example, the sensor can comprise a temperature sensor, a pressure sensor, a strain sensor, a flow sensor, or phase sensor. Also, control line 136 may be used to take a distributed strain measurement along the length of the fiber optic line(s) 136.

In the embodiment in which control line 136 includes an optical fiber, instead of deploying the optical fiber by itself and attaching it to the upper completion 130, the optical fiber can be deployed within a conduit as previously described in relation to the embodiment of FIGS. 1-3. Moreover, the fiber optic line may be deployed already housed within the conduit, or the fiber optic line may be pumped into the conduit once the upper completion 130 is installed, as described in relation to the embodiment of FIGS. 1-3. The control line 136 (and conduit if included) may also be "J-shaped" or "U-shaped."In addition, although one control line 136 is shown, it is understood that more than one control line 136 may be deployed with this embodiment using the same techniques.

In operation, the lower completion 118 is deployed in the wellbore 112 and the packers 120, 121, 123 are set to sealingly anchor the lower completion 118 to the wellbore 112, providing zonal isolation between formations 113, 115. The upper completion 130 is then deployed and the packer 132 is set once the sealing sleeve 143 is sealingly engaged to the packer bore 145. If the wellbore 112 is a producing wellbore, fluid flows from the formation 113, into the wellbore 112, through the fluid communication component 122, into the lower completion interior bore 124, through the flow control component 139, and into and through the upper completion 30 to the surface. Similarly, fluid flows from the formation 115, into the wellbore 112, through the fluid communication component 125, into the lower completion interior bore 124, through the flow control component 141, and into and through the upper completion 30 to the surface. If the wellbore is an injection wellbore, fluid flows in the opposite direction from the surface and into the formations 113, 115.

The flow control components 139, 141 may comprise any downhole valve, such as sleeve valves, ball valves, or disc valves. The components 139, 141 may be remotely controlled (actuated) by additional control lines (hydraulic, electric, or fiber optic—also deployed through the by-pass ports of the sealing sleeve 143 and packer 132) or by wireless signals (pressure pulses, acoustic signals, electromagnetic signals, or seismic signals). Having a flow control component 139, 141 associated with each formation 113, 115 provides an operator with the ability to independently control flow to or from each formation.

If the control line 136 and unit 137 comprise a distributed temperature sensor system, distributed temperature traces can be taken along the length of the control line to provide the required information for the operator, including information relevant to both formations 113, 115. If the control line 136 is used to control downhole devices, an operator may then activate such control. If the control line 136 transmits information to the surface, such information may then be transmitted.

Figure 9:
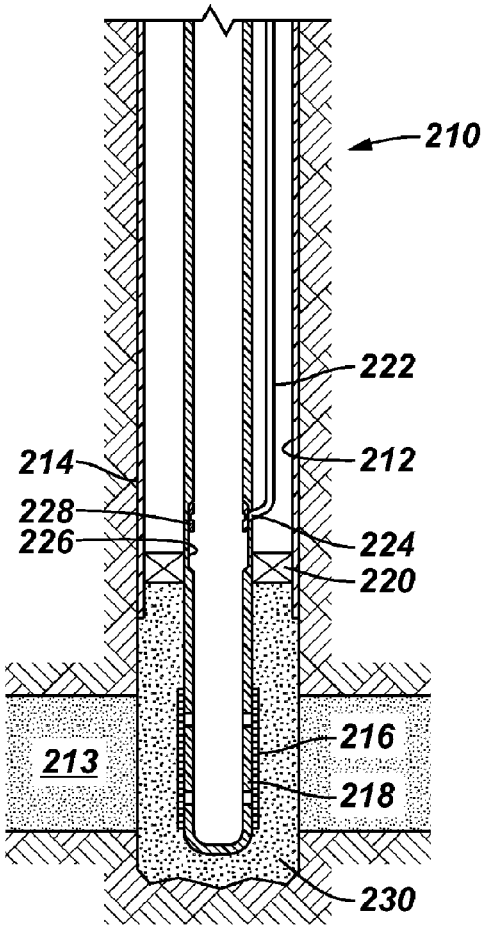
FIGS. 9-10 are schematic illustrations s of a another embodiment of the system illustrated in FIG. 1.
Figure 10:
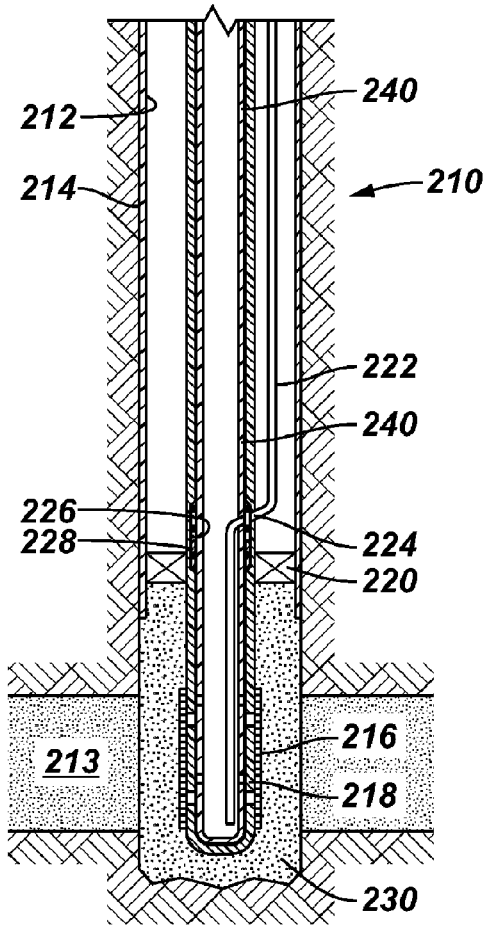

FIGS. 9 and 10 illustrate another embodiment of the invention. A completion 210 is deployed in a wellbore 212. The wellbore 212 may or may not include casing 214. The wellbore 212 extends from a subterranean location to, for example, the surface of the earth (not shown). The wellbore 212 may be a land well or an offshore well. The wellbore 212 intersects a formation 213 from which fluids (such as hydrocarbons) are produced to the surface or into which fluids (such as water or treating fluids) are injected from the surface.

Completion 210 may be a gravel pack completion including a sand screen 216, perforated base pipe 218, and packer 220. The packer 220 seals and anchors the completion 210 against the casing 214.

A control line 222, such as a hydraulic control line or conduit, extends from the surface along the completion 210 towards the packer 220. At a point above the packer 220, the control line 222 extends to a port 224. Port 224 extends through completion 210. On the interior of the completion 210, port 224 is located in a groove 226 that extends longitudinally along a portion of the completion interior. As shown in FIG. 9, a sleeve 228 is located within groove 226 and initially covers port 224. In one embodiment, sleeve 228 sealingly covers port 224. When the sleeve 228 is in the position covering port 224, a tool, such as a gravel pack service tool, may be deployed in the wellbore 112 and gravel pack 230 may be introduced therein. Once the gravel pack 230 is in place, an operator may place the wellbore 12 into production.

Figure 11:
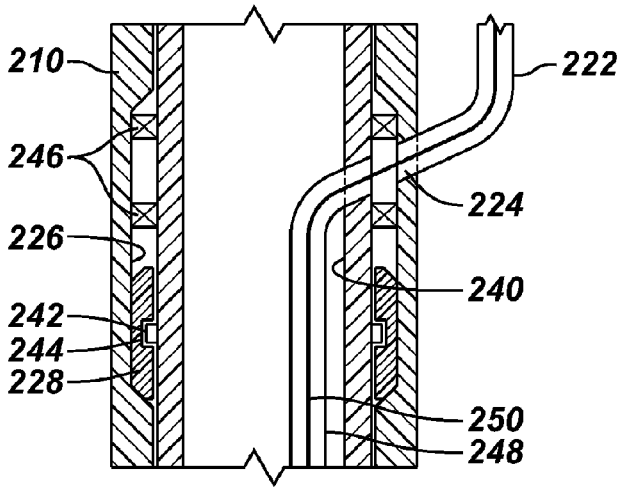
FIG. 11 is an enlarged view of an embodiment of an engagement mechanism between the running tool and the completion illustrated in FIGS. 9-10.

At some point during the life of the wellbore 12, the operator may wish to obtain a temperature trace of the wellbore 12, such as by using the distributed temperature sensor system previously described in relation to the embodiments of FIGS. 1-3. If this is the case, a running tool 240 may be deployed in the wellbore 12 as shown in FIGS. 10 and 11. The running tool 240 engages sleeve 228 and displaces it along the profile 226, as more clearly shown in FIG. 11.

Running tool 240 includes a profile 242 that matches a profile 244 on the interior of sleeve 228. Thus, when the two profiles 242, 244 come in contact, they mate and the running tool 240 moves sleeve 228 downwardly, thereby exposing the port 224. The downward movement of sleeve 228 stops at the end of the groove 226 at which point the port 224 is fully exposed, and the port 224 is disposed between two seals 246 on the exterior of running tool 240. At this position, a hydraulic control line 248 of running tool 240 is connected to and is in fluid communication with the port 224 and the control line 222.

At this location, a common path is formed between and including the hydraulic control lines 222, 248. An optical fiber 250 may be pumped into the common path and through the port 224 as previously described in relation to the embodiment of FIGS. 1-3. Thus, a temperature trace may be obtained by an operator. The control line 248 may extend downwardly across the sand screen 216 to enable an operator to obtain the temperature trace across the screen 216 and formation 213. Once the information is obtained, the optical fiber 250 may be removed from the control lines 222, 248 (such as by reversing pumping or pulling), and the running tool 240 may be removed from the wellbore 212. When the running tool 240 is removed from the wellbore 212, the sleeve 228 is returned to its position of FIG. 9 (covering the port 224) by the continued interaction of the matching profiles 242, 244. Upward movement of the sleeve 228 ends at the top of groove 226, at which point the profiles 242, 244 disengage.

Thus, with this embodiment, temperature traces can be taken in the wellbore 212 at different times during the life of the well. Although a gravel pack/sand control completion was described and illustrated, it is understood that this embodiment may be used with other types of completions in which intermittent use of temperature traces are desired. The completion need only include the groove, sleeve, and port (or similar mechanisms) as indicated. For instance, the releasable assembly of FIGS. 9 and 10 may be used to implement the alternative embodiment described in relation to FIGS. 1-3 wherein the stinger 34 is deployed subsequent to the packer 32 and engagement section 38.

Figure 12:
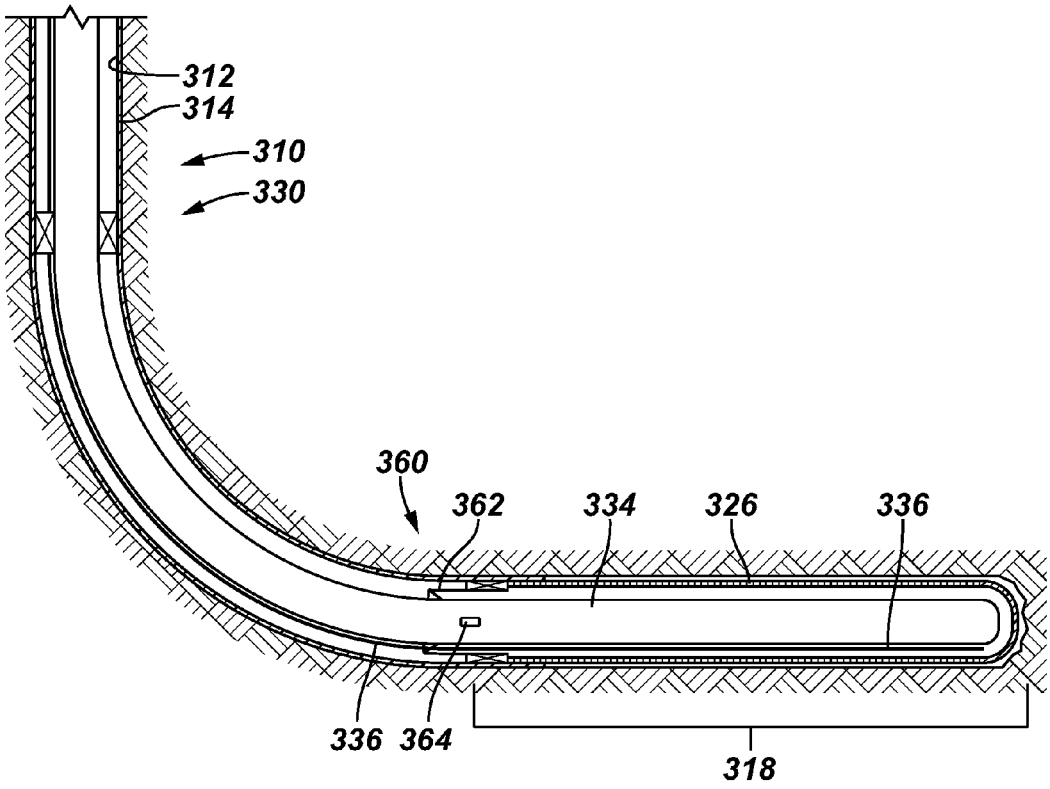
FIGS. 12-14 are schematic illustrations representing another embodiment of the present invention.
Figure 13:
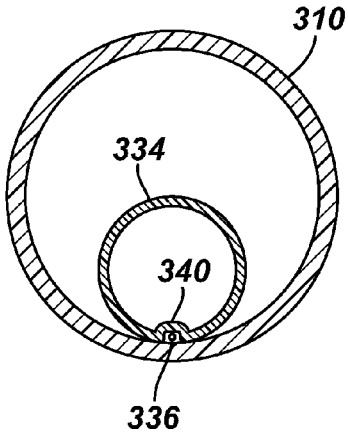
Figure 14:
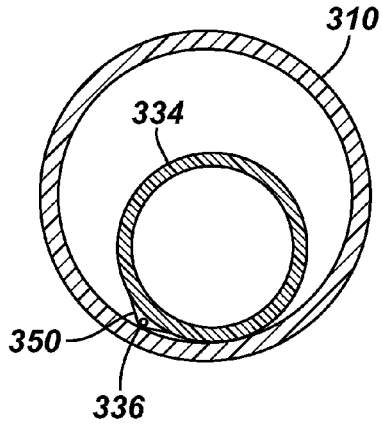

FIGS. 12-14 illustrate another embodiment of the present invention. The completion 310 shown in FIG. 12 is similar to the completion of FIG. 1, except that the completion 310 of FIG. 12 is in a partially cased 314 deviated wellbore 312. The lower completion 318 as shown includes an expandable sand screen 326, although it may include other components such as a regular sand screen or other fluid communication components. The upper completion 330 includes a stinger 334 and a control line 336, among other components. It is noted that other components and parts described in relation to the embodiment of FIGS. 1-3 may also be included in the present embodiment.

In the illustrated embodiment, the stinger 334 is adjustable so the control line 336 may be turned to a desired orientation, such as toward the bottom of the completion 310. This is particularly useful when the control line 336 includes an optical fiber serving as part of a distributed temperature sensor system (as previously described). In this case, the bottom orientation of the optical fiber 336 serves to shield it from the production flow and thereby improve the temperature data. The present invention is particularly useful when the lower completion 318 includes expandable screens because placing a fiber 336 on the exterior of an expandable screen 336 is very difficult and often can lead to the fiber 336 being destroyed during the expansion process. One problem in utilizing a stinger 334 deployed control line 336 is that the data read by the fiber 336 inside the completion 310 may be clouded by the production flow moving past. Orienting the fiber 336 to the bottom of the completion 310 (assuming a deviated completion) can minimize the temperature error by shielding the fiber 336 from production flow.

FIG. 13 illustrates one way to achieve the desired ability to orient the control line. In this Figure, the stinger 334 includes a recess 340 and the control line 336 is deployed along the recess 340 (similar to the recess 40 of FIGS. 1-3). In the alternative shown in FIG. 14, the control line 336 is encased in a specially shaped encapsulation 350 and the stinger 334 comprises a standard, round pipe to shield the fiber from the production flow. The encapsulation is illustrated along an exterior of stinger 334, but it also can be located in an interior of the stinger.

With the use of either the embodiment of FIG. 13 or 14, the stinger 334 can be oriented by an orienting mechanism 360 (see FIG. 12). The orienting mechanism 360 can be either electrical or mechanical. For instance, the orienting mechanism 360 can comprise an orientation guide 362 (such as muleshoe) on the lower completion 318 selectively mateable to a protrusion 364 on the upper completion 330 which when engaged rotates the upper completion 330 so that the control line 336 is proximate the bottom. Alternatively, an azimuthal wireline or LWD/MWD tool can be used to run the stinger 334 and properly orient the control line 336.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system for use in a well, comprising:

a lower completion sized for insertion into a wellbore;

an upper completion having a stinger for insertion into the lower completion; and a control line disposed along at least a portion of the stinger, wherein the control line is positioned along an exterior of the stinger, wherein the stinger comprises a protection mechanism for the control line, the protection mechanism comprising a recess formed in a wall of the stinger.

2. The system as recited in claim 1, wherein the upper completion comprises a packer that moves with the stinger when the stinger is inserted into the lower completion.

3. The system as recited in claim 1, wherein the recess is generally linear and oriented in an axial direction.

4. The system as recited in claim 1, wherein the lower completion comprises a lower packer and the upper completion comprises an upper packer, the control line being routed through a by-pass port of the upper packer.

5. The system as recited in claim 1, wherein the stinger comprises a perforated base pipe and an outlying shroud.

6. The system as recited in claim 1, wherein the control line comprises an optical fiber.

7. The system as recited in claim 1, wherein the control line comprises a plurality of control lines.

8. The system as recited in claim 1, wherein the control line is coupled to a downhole sensor.

9. The system as recited in claim 1, wherein the control line comprises a distributed temperature sensor.

10. The system as recited in claim 1, wherein the lower completion and the stinger extend into a deviated wellbore.

11. The system as recited in claim 10, further comprising an orienting mechanism to place the control line at a desired orientation within the deviated wellbore.

12. A system for use in a well, comprising:

a lower completion sized for insertion into a weilbore;

an upper completion having a stinger for insertion into the lower completion;

a control line disposed along at least a portion of the stinger, wherein the control line is positioned along an exterior of the stinger; and a sealing sleeve to sealingly engage the lower completion and the upper completion, the control line being disposed through the sealing sleeve.

13. A system for use in a well, comprising:

a lower completion sized for insertion into a deviated wellbore;

an upper completion having a stinger for insertion into the lower completion;

a control line disposed along at least a portion of the stinger; and an orienting mechanism to orient the control line within the deviated wellbore.

14. The system as recited in claim 13, wherein the orienting mechanism orients the control line toward a bottom of the deviated wellbore.

15. The system as recited in claim 13, wherein the control line comprises an optical fiber.

16. The system as recited in claim 13, wherein the control line comprises a distributed temperature sensor.

17. The system as recited in claim 13, wherein the upper completion comprises a packer that moves with the stinger during insertion of the stinger.

18. A method, comprising:

combining an upper completion, having a packer and stinger, with a production tubing;

deploying a lower completion in a wellbore;

moving the production tubing and the upper completion simultaneously into the wellbore until the upper completion engages the lower completion such that the stinger extends into the lower completion; and routing a control line along the stinger, wherein routing comprises routing the control line within a recess formed in a wall of the stinger.

19. The method as recited in claim 18, wherein deploying comprises deploying the lower completion with a fluid communication component that provides fluid communication between an exterior of the lower completion and an interior.

20. The method as recited in claim 19, wherein inserting comprises moving the stinger through the fluid communication component.

21. The method as recited in claim 20, wherein routing comprises routing the protected control line through the packer from an interior of the lower completion to an exterior of the upper completion.

22. The method as recited in claim 18, wherein routing comprises routing the protected control line along an interior of the stinger.

23. The method as recited in claim 18, further comprising orienting the recess in a generally axial direction along the stinger.

24. The method as recited in claim 18, further comprising forming the recess along an exterior of the stinger.

25. The method as recited in claim 18, further comprising forming the stinger with a perforated base pipe and an external shroud.

26. The method as recited in claim 18, further comprising forming the stinger with a plurality of base pipe sections and a plurality of corresponding shroud sections.

27. The method as recited in claim 26, further comprising rotationally engaging the plurality of base pipe sections with the plurality of corresponding shroud sections.

28. The method as recited in claim 18, further comprising forming the stinger with a base pipe enclosed by a hinged shroud.

29. The method as recited in claim 18, wherein routing comprises routing a fiber optic control line along the stinger.

30. The method as recited in claim 18, wherein routing comprises routing a distributed temperature sensor along the stinger.

31. A system for use in a well, comprising:

means for inserting a stinger into an interior of the completion; and means for routing a control line along an exterior of the stinger, wherein the means for routing comprises an encapsulation in which the control line is encapsulated.

32. The system as recited in claim 31, wherein the means for inserting comprises an upper completion.

* * * * *